United States Patent [19]

McMullen et al.

[11] 4,014,759

[45] Mar. 29, 1977

[54] ELECTROPLATING IRON ALLOYS CONTAINING NICKEL, COBALT OR NICKEL AND COBALT

[75] Inventors: Warren H. McMullen, East Brunswick; Thomas J. Mooney, Edison, both of N.J.

[73] Assignee: M & T Chemicals Inc., Greenwich, Conn.

[22] Filed: July 9, 1975

[21] Appl. No.: 594,214

[52] U.S. Cl. ..... 204/43 T

[51] Int. Cl.[2] ..... C25D 3/56

[58] Field of Search ..... 204/43 T, 43 P, 43 N, 204/123; 106/1

[56] References Cited

UNITED STATES PATENTS

| | | | |
|---|---|---|---|
| 3,354,059 | 11/1967 | Koretzky | 204/43 T X |
| 3,878,067 | 4/1975 | Tremmel | 204/43 T |
| 3,922,209 | 11/1975 | Passal | 204/43 T |

*Primary Examiner*—G. L. Kaplan
*Attorney, Agent, or Firm*—Kenneth G. Wheeless; Robert P. Auber; Robert Spector

[57] ABSTRACT

In accordance with certain of its aspects, this invention relates to a process for the preparation of an electrodeposit which contains iron and at least one metal selected from the group consisting of nickel and cobalt which comprises passing current from an anode to a cathode through an aqueous plating solution containing an iron compound and at least one member selected from the group consisting of cobalt compounds and nickel compounds providing cobalt or nickel ions for electrodepositing alloys of iron with cobalt and/or nickel and containing in combination an effective amount of:

1. at least one member selected from the group of cooperating additives consisting of ascorbic acid, isoascorbic acid, and erythorbic acid; and
2. the reaction product of an aromatic sulfinate and an aldehyde or aldehyde derivative; for a time period sufficient to form a sound metal electroplate upon said cathode surface.

18 Claims, No Drawings

ELECTROPLATING IRON ALLOYS CONTAINING NICKEL, COBALT OR NICKEL AND COBALT

This invention relates to improved processes and compositions for the electrodeposition of semi-bright or bright iron alloys with nickel or cobalt or nickel and cobalt. More particularly, this invention relates to the use of a new additive combination to improve the plating of iron-containing alloys of nickel, cobalt and nickel-cobalt.

Because of the much lower cost of iron and its salts as contrasted to that of nickel and cobalt and their salts it would be highly desirable to electrodeposit alloys of nickel or cobalt or nickel and cobalt with iron containing an appreciable iron content thereby reducing metal and salt costs.

DETAILED DESCRIPTION

In accordance with certain of its aspects, this invention relates to a process for the preparation of an iron alloy electrodeposit which contains in addition to iron, nickel or cobalt or nickel and cobalt which comprises passing current from an anode to a cathode through an aqueous plating solution containing at least one iron compound and nickel or cobalt or nickel and cobalt compounds to provide nickel, cobalt and iron ions for electrodepositing alloys of nickel or cobalt or nickel and cobalt with iron.

The baths contain an effective amount of at least one member selected from the group consisting of:

a. primary brightener;

b. secondary brightener;

c. secondary auxiliary brightener;

d. anti-pitting agent;

e. the reaction product of an organic aromatic sulfinate compound of the formula:

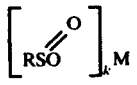

wherein M is a cation having a valence of 1–2; $k$ is an integer 1–2 corresponding to the valence of M; and R is aryl or aralkyl; an aldehyde or aldehyde derivative said reaction product exhibiting the formula:

$$R'\ C_6H_4\ SO_2\ CHOH\ R$$

wherein R and R′ are each, independently, selected from the group consisting of hydrogen, alkyl, aralkyl, aryl, alkaryl, and alkali metal derivatives thereof; and f. an hydroxy complexing compound selected from the group consisting of ascorbic acid, erythorbic acid, and isoascorbic acid; for a time period sufficient to form a sound metal electroplate upon said cathode surface.

Highly preferred reaction products of an aromatic sulfinate and an aldehyde are the reaction products of p-toluene sulfinate and formaldehyde.

Other highly preferred reaction products are those exhibiting the formula:

$$R'\ C_6H_4\ SO_2\ CHOH\ R$$

wherein R and R′ are each, independently, selected from the group consisting of hydrogen, alkyl, aralkyl, aryl, and alkaryl provided that R includes alkali metal derivatives of the foregoing.

The preferred aryl sulfinates of this invention are benzene sulfinate and toluene sulfinate. Other operable aryl sulfinates include xylene sulfinates and naphthalene sulfinates. Erythorbic acid (ascorbic and isoascorbic) and the reaction product of an aldehyde and an aromatic sulfinate act synergistically in reducing and controlling the formation of iron and thus allow a bright, leveled plate to be obtained at the higher pH range. It is desirable to operate an iron alloy bath at the higher pH in order to reduce the attack of the plating solution on the iron anode during idle periods and thereby obtaining a more stable bath composition.

Ascorbic acid exhibits the formula:

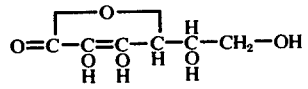

Erythorbic acid and isoascorbic acid are optical isomers of ascorbic acid.

This invention has probatively shown that erythorbic acid and aldehyde adducts of aromatic sulfinates such as benzene sulfinate and/or toluene sulfinate act together to prevent the oxidation and precipitation of iron ions at a pH of 4.0 to 5.5 and produce a bright plate having a wide current density range. Operation of the plating bath in this pH range gives a higher rate of brightening, higher specularity, greater leveling and better throwing power than the lower pH range.

Ascorbic acid, erythorbic acid, and isoascorbic acid are present in the baths in a sole or combined concentration of from 1 gram per liter to 15 grams per liter.

At least one aldehyde adduct of an aromatic sulfinate is present in the baths in a concentration of from 0.01 gram per liter to 10.0 grams per liter.

For bright, well-leveled alloy plating primary brighteners such as diethoxylated 2 butyne-1,4-diol or dipropoxylated 2 butyne-1,4-diol may be used in cooperation with a sulfo-oxygen secondary brightener, preferably saccharin, a secondary auxiliary brightener and an anti-pitter. If full brightness and leveling are not desired a fairly lustrous deposit with fair leveling may be obtained using as a primary brightener a nitrogen heterocyclic compound such as N-allyl quinolinium bromide at a concentration of about 5 to 20 mg/l in cooperation with a sulfo-oxygen secondary brightener, a secondary auxiliary brightener and an anti-pitter.

The substrates on which the nickel-iron, cobalt-iron or nickel-cobalt-iron-containing electrodeposits of this invention may be applied, may be metal or metal alloys such as are commonly electrodeposited and used in the art of electroplating such as nickel, cobalt, nickel-cobalt, copper, tin, brass, etc. Other typical substrate basis metals from which articles to be plated are manufactured may include ferrous metals such as steel; copper; alloys of copper such as brass, bronze, etc.; zinc, particularly in the form of zinc-base die castings; all of which may bear plates of other metals, such as copper, etc. Basis metal substrates may have a variety of surface finishes depending on the final appearance desired, which in turn depends on such factors as luster, brilliance, leveling, thickness, etc. of the nickel-iron, cobalt-iron and nickel-cobalt-iron containing electroplate applied on such substrates.

The term "primary brightener" as used herein is meant to include plating additive compounds such as reaction products of epoxides with alpha-hydroxy acetylenic alcohols such as diethoxylated 2 butyne-1,4-diol or dipropoxylated 2 butyne-1,4-diol, other acetylenics, N-heterocyclics, active sulfur compounds, dye-stuffs, etc. Specific examples of such plating additives are:

1,4-di-(β-hydroxyethoxy)-2-butyne (or diethoxylated 2 butyne-1,4, diol)
1,4-di-(β-hydroxy-γ-chloropropoxy)-2-butyne
1,4-di-(β-γ-epoxypropoxy)-2-butyne
1,4-di-(β-hydroxy-γ-butenoxy)-2-butyne
1,4-di-(2'-hydroxy-4'-oxa-6'-heptenoxy)-2-butyne
N-1,2-dichloropropenyl pyridinium chloride
2,4,6-trimethyl N-propargyl pyridinium bromide
N-allyl quinaldinium bromide
N-allyl quinolinium bromide
2-butyne-1,4-diol
propargyl alcohol
2-methyl-3-butyn-2-ol
thiodiproprionitrile

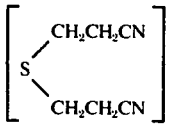

thiourea
phenosafranin
fuchsin

When used alone or in combination, a primary brightener may produce no visual effect on the electrodeposit, or may produce semi-lustrous, fine-grained deposits. However, best results are obtained when primary brighteners are used with either a secondary brightener, a secondary auxiliary brightener, or both, in order to provide optimum deposit luster, rate of brightening, leveling, bright plate current density range, low current density coverage, etc.

The term "secondary brightener" as used herein is meant to include aromatic sulfonates, sulfonamides, sulfonimides, sulfinates, etc. Specific examples of such plating additives are:

1. saccharin
2. trisodium 1,3,6-naphthalene trisulfonate
3. sodium benzene monosulfonate
4. dibenzene sulfonimide
5. sodium benzene monosulfinate Such plating additive compounds, which may be used singly or in suitable combinations, have one or more of the following functions:

1. To obtain semi-lustrous deposits or to produce substantial grain-refinement over the usual dull, matte, grainy, non-reflective deposits from additive free baths.
2. To act as ductilizing agents when used in combination with other additives such as primary brighteners.
3. To control internal stress of deposits, generally by making the stress desirably compressive.
4. To introduce controlled sulfur contents into the electrodeposits to desirably affect chemical reactivity, potential differences in composite coating systems, etc. thereby decreasing corrosion, better protecting the basis metal from corrosion, etc.

The term "secondary auxiliary brightener" as used herein is meant to include aliphatic or aromatic-aliphatic olefinically or acetylenically unsaturated sulfonates, sulfonamides, or sulfonimides, etc. Specific examples of such plating additives are:

1. sodium allyl sulfonate
2. sodium-3-chloro-2-butene-1-sulfonate
3. sodium β-styrene sulfonate
4. sodium propargyl sulfonate
5. monoallyl sulfamide ($H_2N—SO_2—NH—CH_2—CH=CH_2$)
6. diallyl sulfamide

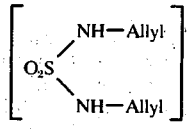

7. allyl sulfonamide

Such compounds, which may be used singly (usual) or in combination, have all of the functions given for the secondary brighteners and in addition may have one or more of the following functions:

1. They may act to prevent or minimize pitting (probably acting as hydrogen acceptors).
2. They may cooperate with one or more secondary brighteners and one or more primary brighteners to give much better rates of brightening and leveling than would be possible to attain with any one or any two compounds selected from all three of the classes:
   1. primary brightener;
   2. secondary brightener; and
   3. secondary auxiliary brightener used either alone or in combination.
3. They may condition the cathode surface by catalytic poisoning, etc. so that the rates of consumption of cooperating additives (usually of the primary brightener type) may be substantially reduced, making for better economy of operation and control.

Among the secondary auxiliary brighteners one may also include ions or compounds of certain metals and metalloids such as zinc, cadmium, selenium, etc. which, although they are not generally used at present, have been used to augment deposit luster, etc.

The term "anti-pitting agent" as used herein is an organic material (different from and in addition to the secondary auxiliary brightener) which has surfactant properties and which functions to prevent or minimize gas pitting. An anti-pitting agent may also function to make the baths more compatible with contaminants such as oil, grease, etc. by their emulsifying, dispersing, solubilizing, etc. action on such contaminants and thereby promote attaining of sounder deposits. Anti-pitting agents are optional additives which may or may not be used in combination with one or more members selected from the group consisting of a primary brightener, a secondary brightener, and a secondary auxiliary brightener. Of the four classes of organic surfactants, i.e., anionic, cationic, nonionic or amphoteric, the type commonly used for the electrodeposition of Ni, Co, Fe, or alloys thereof and for functioning as anti-pitters is the anionic class. The anionic class individual members commonly used may be exemplified by the following:

sodium lauryl sulfate
sodium lauryl ether sulfate
sodium di-alkylsulfosuccinates
sodium 2-ethylhexyl sulfate Typical nickel-iron-containing, cobalt-iron-containing, and nickel-cobalt-iron-containing bath compositions which may be used in combination with effective amounts of about 0.005–0.2 grams per liter of the primary brightener, with about 1.0–30 grams per liter of the secondary brightener, with about 0.5–10 grams per liter of the secondary auxiliary brightener, and with about 0.05–1 gram per liter of anti-pitting agent, described herein, are summarized below. Combinations of primary brighteners and of secondary brighteners may also be used with the total concentration of members of each class coming within the typical concentration limits stated.

Typical nickel-containing, cobalt-containing, and nickel-cobalt-containing bath compositions also containing iron which may be used in combination with effective amounts of about 0.005–0.2 grams per liter of the primary brighteners, with about 1.0–30 grams per liter of the secondary brightener, with about 0.5–10 grams per liter of the secondary auxiliary brightener, and with about 0.05–1 gram per liter of anti-pitting agent, described herein are summarized below. Boric acid should be present in an amount of from 15 grams per liter to 60 grams per liter.

Typical aqueous nickel-containing electroplating baths (which may be used in combination with effective amounts of cooperating additives) include the following wherein all concentrations are in grams per liter (g/l) unless otherwise indicated.

Salts to make up the bath are of the types generally used for nickel and cobalt plating, i.e., the sulfates and chlorides, usually combinations thereof. Ferrous iron may be added as Ferrous Sulfate or Ferrous Chloride, or ferrous Sulfamate, preferably the sulfate which is easily available at low cost and good degree of purity (as $FeSO_4 \cdot 7H_2O$).

TABLE I

AQUEOUS NICKEL-CONTAINING ELECTROPLATING BATHS

| Component | Minimum | Maximum | Preferred |
|---|---|---|---|
| nickel sulfate | 200 | 500 | 300 |
| nickel chloride | 30 | 80 | 45 |
| ferrous sulfate | 5 | 80 | 40 |
| boric acid | 35 | 55 | 45 |
| erythorbic acid, ascorbic acid, or isoascorbic acid | 1 | 15 | 7.5 |
| aldehyde adduct of aryl sulfinate | 0.1 | 5 | 0.5 |
| pH (electrometric) | 3 | 7 | 4 |

A typical sulfamate-type nickel plating bath which may be used in practice of this invention may include the following components:

TABLE II

| Component | Minimum | Maximum | Preferred |
|---|---|---|---|
| nickel sulfamate | 330 | 400 | 375 |
| nickel chloride | 15 | 60 | 45 |
| ferrous sulfamate | 5 | 60 | 40 |
| boric acid | 35 | 55 | 45 |
| erythorbic acid, ascorbic acid, or isoascorbic acid | 1 | 15 | 7.5 |
| aldehyde adduct of aryl sulfinate | 0.1 | 5 | 0.5 |
| pH (electrometric) | 3 | 7 | 4 |

A typical chloride-free sulfate-type nickel plating bath which may be used in practice of this invention may include the following components:

TABLE III

| Component | Minimum | Maximum | Preferred |
|---|---|---|---|
| nickel sulfate | 300 | 500 | 400 |
| ferrous sulfate | 5 | 60 | 45 |
| boric acid | 35 | 55 | 45 |
| erythorbic acid, ascorbic acid, or isoascorbic acid | 1 | 15 | 7.5 |
| aldehyde adduct of aryl sulfinate | 0.1 | 5 | 0.5 |
| pH (electrometric) | 2.5 | 7 | 3–3.5 |

A typical chloride-free sulfamate-type nickel plating bath which may be used in practice of this invention may include the following components:

TABLE IV

| Component | Minimum | Maximum | Preferred |
|---|---|---|---|
| nickel sulfamate | 300 | 400 | 350 |
| ferrous sulfamate | 5 | 60 | 45 |
| boric acid | 35 | 55 | 45 |
| erythorbic acid, ascorbic acid, or isoascorbic acid | 1 | 15 | 7.5 |
| aldehyde adduct of aryl sulfinate | 0.1 | 5 | 0.5 |
| pH (electrometric) | 3 | 7 | 3–3.5 |

It will be apparent that the above baths may contain compounds in amounts falling outside the preferred minimum and maximum set forth, but most satisfactory and economical operation may normally be effected when the compounds are present in the baths in the amounts indicated. A particular advantage of the chloride-free baths of Tables III and IV, supra, is that the deposits obtained may be substantially free of tensile stress and may permit high speed plating involving the use of high speed anodes.

The following is an aqueous cobalt-nickel-iron-containing electroplating bath in which the combination of effective amounts of one or more cooperating additives according to this invention will result in beneficial effects.

TABLE V

AQUEOUS COBALT-NICKEL-IRON-CONTAINING ELECTROPLATING BATH
(All concentrations in g/l unless otherwise noted)

| Cobalt-Nickel Alloy Bath | Minimum | Maximum | Preferred |
|---|---|---|---|
| $NiSO_4 \cdot 7H_2O$ | 200 | 400 | 300 |
| $CoSO_4 \cdot 7H_2O$ | 15 | 225 | 80 |
| $NiCl_2 \cdot 6H_2O$ | 15 | 75 | 60 |
| $H_3BO_3$ | 37 | 50 | 45 |
| $FeSO_4 \cdot 7H_2O$ | 5 | 60 | 45 |
| erythorbic acid, ascorbic acid, or isoascorbic acid | 1 | 15 | 7.5 |
| aldehyde adduct of aryl sulfinate | 0.1 | 5 | 0.5 |

Typical cobalt-iron plating baths are the following:

TABLE VI

| Watts (high sulfate type) | Minimum | Maximum | Preferred |
|---|---|---|---|
| cobalt sulfate | 200 | 500 | 300 |
| cobalt chloride | 45 | 150 | 120 |
| ferrous sulfate | 5 | 60 | 45 |
| boric acid | 15 | 60 | 45 |
| erythorbic acid, ascorbic acid, or isoascorbic acid | 1 | 15 | 7.5 |
| aldehyde adduct of aryl sulfinate | 0.1 | 5 | 0.5 |
| pH (electrometric) | 3.0 | 5.8 | 4.0 |

TABLE VII

| High Chloride Type | Minimum | Maximum | Preferred |
|---|---|---|---|
| cobalt chloride | 100 | 300 | 200 |
| cobalt sulfate | 100 | 300 | 200 |
| ferrous sulfate | 5 | 60 | 45 |
| boric acid | 15 | 60 | 30 |
| erythorbic acid, ascorbic acid, or isoascorbic acid | 1 | 15 | 7.5 |
| aldehyde adduct of aryl sulfinate | 0.1 | 5 | 0.5 |

The pH of all of the foregoing illustrative aqueous iron-nickel-containing, cobalt-iron-containing and nickel-cobalt-iron-containing compositions may be maintained during plating at pH values of 2.0 to 7.0 and preferably from 3.0 to 6.0. During bath operation, the pH may be adjusted with acids such as hydrochloric acid or sulfuric acid, etc.

Operating temperture ranges for the above baths may be about 30° to 70° C. with temperatures within the range of 45° to 65° C. preferred.

Agitation of the above baths during plating may consist of solution pumping, moving cathode rod, air agitation or combinations thereof.

Anodes used in the above baths may consist of the particular single metals being plated at the cathode such as iron and nickel, for plating nickel-iron, cobalt and iron, for plating cobalt-iron, or nickel, cobalt, and iron, for plating nickel-cobalt-iron alloys. The anodes may consist of the separate metals involved suitably suspended in the bath as bars, strips or as small chunks in titanium baskets. In such cases the ratio of the separate metal anode areas is adjusted to correspond to the particular cathode alloy composition desired. For plating binary or ternary alloys one may also use as anodes alloys of the metals involved in such a per cent weight ratio of the separate metals as to correspond to the per cent weight ratio of the same metals in the cathode alloy deposits desired. These two types of anode systems will generally result in a fairly constant bath metal ion concentration for the respective metals. If with fixed metal ratio alloy anodes there does occur some bath metal ion imbalance, occasional adjustments may be made by adding the appropriate corrective concentration of the individual metal salts. All anodes or anode baskets are usually suitably covered with cloth or plastic bags of desired porosity to minimize introduction into the bath of metal particles, anode slime, etc. which may migrate to the cathode either mechanically or electrophoretically to give roughness in cathode deposits.

The following examples are submitted for the purpose of illustration only and are not to be construed as limiting the scope of the invention in any way.

EXAMPLE 1

The formaldehyde adduct of the sulfinate was prepared as follows:

1. 223 g of the crude 34% $CH_3\phi SO_2Na$ was mixed with 110 ccs of 37% $CH_2O$ solution and stirred on a hot plate. The material did not readily dissolve so approximately 100–200 mls of distilled water was added for working properties. A fair amount of solubility was obtained at approximately 50° C.

2. The solution was neutralized with 25% of sulfuric acid and a cloudy murky solution resulted containing trace amounts of undissolved salts. PH at the end was 6:0.

3. The insolubles were filtered off and checked to determine if organic. The material did not burn or char indicating the material to be either NaCl or $Na_2SO_4$.

4. The filtrate obtained was transferred to a gallon plastic jug and 204.3 g of diethoxylated 2-butyne-1,4-diol added.

5. The mixture was diluted to approximately one-half volume and 23.4 g of para toluene sulfonate added.

6. Solution was adjusted to volume and bottled. The final formulation of this material was as follows:

| | 1 Gallon |
|---|---|
| Para toluene sulfinate (100%) | 75.8 g |
| 37% formaldehyde | 110.0 ccs |
| Diethoxylated 2-butyne-1, 4-diol | 204.3 g |
| Para toluene sulfonate | 23.4 g |

EXAMPLE 2

A nickel-cobalt-iron electroplating bath composition was prepared by combining in water the following ingredients to provide the indicated concentrations:

| | | Grams Per Liter (Unless indicated otherwise) |
|---|---|---|
| Nickel Sulfate | | 300 |
| Nickel Chloride | | 60 |
| Boric Acid | | 45 |
| Cobalt Sulfate | | 15 |
| Ferrous Sulfate | | 75 |
| Saccharin | | 4 |
| Ethoxylated Butynediol | | 50 mg/l |
| Allyl Sulfonate | | 4.5 |
| Erythorbic Acid | | 7.5 |
| Formaldehyde Adduct of toluene sulfinic acid | | .5 |
| pH | 4.5 | |
| Temperature | 60° C. | |
| Agitation | Air | |
| Cathode Current Density | 40 ASF | |

A polished brass panel was scribed with a horizontal single pass of 2/0 grit emery to give a band width of about 1 cm. at a distance of about 2.5 cm. from the bottom of the panel. After cleaning the panel, including the use of a thin cyanide copper strike to assure excellent physical and chemical cleanliness, it was plated in a 267 ml. Hull Cell, at a 2 ampere cell current for 10 minutes, at a temperature of 50° C. and using magnetic stirring. The resulting deposit was uniformly fine-grained, glossy, brilliant, well-leveled, ductile with slight tensile stress and excellent low current density coverage. A panel plated in the above bath gave a highly leveled bright deposit which analyzed 20% Co, 40% Fe, and 40% Ni.

EXAMPLE 3

A nickel-iron electroplating bath was prepared as in Example 2 containing:

| | Grams Per Liter (Unless indicated otherwise) |
|---|---|
| Nickel Sulfate | 300 |
| Nickel Chloride | 60 |
| Boric Acid | 45 |
| Ferrous Sulfate | 75 |
| Saccharin | 4 |
| Ethoxylated Butynediol | 50 mg/l |
| Allyl Sulfonate | 4.5 |

-continued

| | | Grams Per Liter (Unless indicated otherwise) |
|---|---|---|
| Erythorbic Acid | | 7.5 |
| Formaldehyde Adduct of Toluene Sulfinate | | .5 |
| pH | | |
| Temperature | | |
| Cathode Current Density | | |
| Anode | Ni 60% Fe 40% | |
| Cathode Analysis | Ni 60% Fe 40% | |

EXAMPLE 4

A cobalt-iron electroplating bath was prepared as in Example 2 containing:

| | | Grams Per Liter (Unless indicated otherwise) |
|---|---|---|
| Cobalt Sulfate | | 300 |
| Cobalt Chloride | | 60 |
| Boric Acid | | 45 |
| Ferrous Sulfate | | 75 |
| Saccharin | | 4 |
| Ethoxylated Butynediol | | 50 mg/l |
| Allyl Sulfonate | | 4.5 |
| Erythorbic Acid | | 3 |
| Formaldehyde Adduct of Toluene Sulfinate | | .5 |
| pH | 4.4 | |
| Temperature | 60° C. | |
| Agitation | Air | |
| Cathode Current Density | 40 ASF | |

A panel plated in the above bath gave a very highly leveled, bright deposit.

EXAMPLE 5

A nickel-iron electroplating bath composition was prepared by combining in water the following ingredients to provide the indicated concentrations:

| | | Grams Per Liter (Unless indicated otherwise) |
|---|---|---|
| Nickel Sulfate | | 300 |
| Nickel Chloride | | 60 |
| Boric Acid | | 45 |
| Ferrous Sulfate | | 75 |
| Sodium Saccharinate | | 4.0 |
| Sodium Allyl Sulfonate | | 2.3 |
| Diethoxylated 2 butyne-1,4-diol | | 50 mg/l |
| Formaldehyde Adduct of Benzene Sulfinate | | .50 |
| Erythorbic Acid | | 8.0 |
| pH | 3.8 | |

A well-leveled ductile deposit with good low current density containing 31.4% iron and 68.6% nickel was obtained.

EXAMPLE 6

The formaldehyde adduct of para toluene sulfinate for use in nickel iron plating was prepared as follows: 334 g of crude 34% para toluene sulfinate was reacted with agitation on a hot plate with 152.2 g of 37% formaldehyde at 50° C. Approximately 200 mls of water was added to give good working properties and the pH of the resulting solution adjusted to 5.5. A trace of insoluble salts was filtered off. The filtrate was poured into a 1 gallon plastic jug and 114 g of Toluene sulfonic acid (Na salt) was added. The solution adjusted to volume.

The final formulation of this material was as follows:

| | 1 Gallon |
|---|---|
| 100% P-Toluene-Sulfinic Acid Na Salt | 114.0 g |
| 37 % $CH_2O$ | 152.4 g |
| Toluene Sulfonate Sodium | 114.8 g |

Although this invention has been illustrated by reference to specific embodiments, modifications thereof which are clearly within the scope of the invention will be apparent to those skilled in the art.

We claim:

1. In a process for the preparation of an iron alloy electrodeposit which contains nickel, cobalt, or nickel and cobalt, which comprises passing current from an anode to a cathode through an aqueous acidic plating solution containing at least one ferrous compound and at least one nickel compound, at least one cobalt compound, or a combination of nickel and cobalt compounds, providing ions for electrodepositing nickel-iron alloy, cobalt-iron alloy, or nickel-cobalt-iron alloy, the improvement comprising in combination:

1. 1 gram per liter to 15 grams per liter of at least one member selected from the group of cooperating additives consisting of ascorbic acid, isoascorbic acid, and erythorbic acid; and
2. 0.01 gram per liter to 10.0 grams per liter of at least one compound exhibiting the formula $$R'C_6H_4SO_2CHOHR$$

wherein R and R′ are each, independently, selected from the group consisting of hydrogen, alkyl, aralkyl, aryl, alkaryl and alkali metal derivatives thereof.

2. The process of claim 1 wherein said nickel compounds are nickel sulfate and nickel chloride.

3. The process of claim 1 wherein said nickel compounds are nickel sulfamate and nickel chloride.

4. The process of claim 1 wherein said cobalt compounds are cobalt sulfate and cobalt chloride.

5. The process of claim 1 wherein said cobalt compounds are cobalt sulfamate and cobalt chloride.

6. The process of claim 1 wherein said ferrous compound is ferrous sulfate, ferrous chloride or ferrous sulfamate.

7. A process for the preparation of an iron alloy electrodeposit which contains nickel, cobalt, or a combination of nickel and cobalt which comprises passing current from an anode to a cathode through an aqueous electroplating solution containing ferrous sulfate, or ferrous chloride, and at least one member selected from the group consisting of nickel compounds, cobalt compounds, or a combination of cobalt and nickel compounds providing nickel ions or nickel and cobalt ions for electrodepositing iron alloys containing nickel or nickel and cobalt and in combination an effective amount of:

1. 1 gram per liter to 15 grams per liter of at least one member selected from the group consisting of a combination or erythorbic acid, ascorbic acid, or isoascorbic acid; and 2. 0.01 gram per liter to 10.0 grams per liter of at least one compound exhibiting the formula $R'C_6H_4SO_2CHOHR$ wherein R and R′ are each, independently, selected from the group consisting of hydrogen, alkyl, aralkyl, aryl, alkaryl and alkali metal derivatives thereof.

8. The process of claim 7 wherein said nickel compounds are nickel sulfate and nickel chloride.

9. In a process for the preparation of an iron alloy electrodeposit which contains as an additional metal, nickel, cobalt, or nickel and cobalt which comprises passing current from an anode to a cathode through an aqueous acidic plating solution containing nickel compounds or nickel and cobalt compounds, the improvement comprising the presence of a combination of 1 gram per liter to 15 grams per liter of erythorbic acid, ascorbic acid, or isoascorbic acid and 0.01 gram per liter to 10.0 grams per liter of at least one compound exhibiting the formula $R'C_6H_4SO_2CHOHR$ wherein R and R′ are each, independently, selected from the group consisting of hydrogen, alkyl, aralkyl, aryl, alkaryl and alkali metal derivatives thereof.

10. The process of claim 9 wherein said nickel compounds and said cobalt compounds are nickel and cobalt sulfates, sulfamates, and chlorides.

11. In an aqueous plating solution containing nickel compounds, cobalt compounds and ferrous compounds, providing ions for electrodepositing nickel-cobalt-iron alloy, the improvement comprising the presence of a combination of 1 gram per liter to 15 grams per liter of erythorbic acid, ascorbic acid, or isoascorbic acid and 0.01 gram per liter to 10.0 grams per liter of at least one compound exhibiting the formula $R'C_6H_4SO_2CHOHR$ wherein R and R′ are each, independently, selected from the group consisting of hydrogen, alkyl, aralkyl, aryl, alkaryl and alkali metal derivatives thereof.

12. The composition as claimed in claim 11 wherein said nickel compounds are nickel sulfate and nickel chloride.

13. The composition as claimed in claim 11 wherein said nickel compounds are nickel sulfamate and nickel chloride.

14. The composition as claimed in claim 11 wherein said cobalt compounds are cobalt sulfate and cobalt chloride.

15. The composition as claimed in claim 11 wherein said cobalt compounds are cobalt sulfamate and cobalt chloride.

16. The composition as claimed in claim 11 wherein said ferrous compound is ferrous sulfate, ferrous chloride or ferrous sulfamate.

17. An aqueous electroplating solution which contains ferrous sulfate or ferrous chloride, and nickel compounds or nickel and cobalt compounds providing nickel or nickel and cobalt ions for electrodepositing nickel-iron, cobalt-iron, or nickel-cobalt-iron, containing in combinations:

1. 1 gram per liter to 15 grams per liter of at least one member selected from the group consisting of erythorbic acid, ascorbic acid, or isoascorbic acid; and
2. 0.01 gram per liter to 10.0 grams per liter of at least one compound exhibiting the formula $R'C_6H_4SO_2CHOHR$ wherein R and R′ are each, independently, selected from the group consisting of hydrogen, alkyl, aralkyl, aryl, alkaryl and alkali metal derivatives thereof.

18. The composition of claim 17 wherein said nickel compounds are nickel sulfate and nickel chloride.

* * * * *